US005513746A

United States Patent [19]

Anderson

[11] Patent Number: 5,513,746

[45] Date of Patent: May 7, 1996

[54] PORTABLE DISPLAY DEVICE

[76] Inventor: James K. Anderson, 5505 Malibu Dr., Edina, Minn. 55436

[21] Appl. No.: 255,425

[22] Filed: Jun. 8, 1994

[51] Int. Cl.[6] ..... B65D 85/62

[52] U.S. Cl. ..... 206/738; 206/232; 206/555; 206/745

[58] Field of Search ..... 206/45.13, 45.15, 206/45.18, 308.1, 308.3, 387.1, 555, 232

[56] References Cited

U.S. PATENT DOCUMENTS

| | | | |
|---|---|---|---|
| 3,232,397 | 2/1966 | McCoy | 206/555 |
| 3,754,639 | 8/1973 | Gellert | 206/387.1 |
| 4,149,629 | 4/1979 | Eckmann et al. . | |
| 4,496,050 | 1/1985 | Kirchner | 206/308.3 |
| 4,498,583 | 2/1985 | Long et al. | 206/308.3 |
| 4,508,217 | 4/1985 | Long et al. | 206/308.3 |
| 4,586,603 | 5/1986 | Long et al. | 206/308.3 |
| 4,651,876 | 3/1987 | Tanuma et al. | 206/387.1 |
| 4,736,837 | 4/1988 | Brainard . | |
| 4,746,009 | 5/1988 | Liberman . | |
| 4,844,264 | 7/1989 | Deskiewicz, Jr. . | |
| 4,913,287 | 4/1990 | Kagano | 206/387.1 |
| 4,947,989 | 8/1990 | Horton | 206/387.1 |
| 4,949,849 | 8/1990 | Hardy . | |
| 4,975,137 | 12/1990 | Cross . | |
| 4,995,508 | 2/1991 | Burley . | |
| 5,180,058 | 1/1993 | Hu | 206/308.3 |
| 5,355,997 | 10/1994 | Kikuchi | 206/308.3 |

*Primary Examiner*—Jimmy G. Foster
*Attorney, Agent, or Firm*—Dorsey & Whitney

[57] ABSTRACT

The present invention provides a portable display device for transporting and displaying material. The display device has a main, base tray component and a display member component. The base tray component and display member are semi-permanently attached. The display member component has at least one internal cavity and one associated external receptacle and is movable relative to the base tray component between a closed transport position and an open display position. When in the closed transport position, the base tray and display member are nested, and when in the open display portion, the display member component is generally upright and transverse relative to the base tray.

11 Claims, 2 Drawing Sheets

PORTABLE DISPLAY DEVICE

TECHNICAL FIELD

The present invention relates to devices for displaying material and, more particularly, to a portable display device for transporting and displaying material.

BACKGROUND OF THE INVENTION

There are many known display devices. Such devices are usually adapted for containing and displaying specific items. For example, U.S. Pat. Nos. 4,949,849 (Hardy) and 4,995,508 (Burley) respectively disclose an adjustable greeting card display assembly and a display case for sports cards.

U.S. Pat. No. 4,736,837 (Brainard) and 4,746,009 (Lieberman) disclose display devices including hingedly-connected sections or elements, wherein when closed, the devices have an enclosed storage or transporting space. Somewhat similarly, U.S. Pat. No. 4,149,629 (Eckmann et al.) discloses a container for a product which protects the product during shipping and storage and then may be opened to display the product.

A hinged display mount of the type generally used for displaying a desktop calendar is disclosed in U.S. Pat. No. 4,975,137 (Cross). The Cross display mount includes hingedly coupled panels and may be manipulated into various configurations, including a layered configuration for shipping.

One advantage of known display devices, including those disclosed in the above-noted patents, is that they assist in organizing and keeping the displayed material attractively arranged at the point of use. U.S. Pat. No. 4,844,264 (Deskiewicz, Jr.) is particularly directed to this problem and, even more particularly, to this problem in the context of the real estate market. To solve the problem of organizing and attractively displaying sales information and material such as specification sheets, brochures and business cards at the site of real estate which is for sale, the Deskiewicz patent discloses a display tray having a main tray portion and a stand portion removably attached to the main tray portion. The main tray portion includes a front compartment for holding business cards.

The display tray disclosed by Deskiewicz provides some significant advantages while in use on site, i.e., it helps keep sales material organized and attractively displayed, but there is at least one problem which is unaddressed. Specifically, although the Deskiewicz display tray is supposed to be easily portable while in use at a site, it is comprised of at least two separate pieces which must be disassembled for transporting the tray from one site to another. Obviously, it must be assembled for use. Further, any display material in the tray must be removed prior to the disassembly process, then reorganized and replaced after the tray is reassembled at the same or another point of use. Accordingly, there is a need for a simple, durable conveniently portable display device for enabling the attractive, well organized display of material, as well as the efficient transportation of the device and displayed material.

SUMMARY OF THE INVENTION

In accordance with the present invention, a portable display device for organizing and displaying material is provided. The display device comprises a base tray and a display member semi-permanently and movably connected to the base tray. The display member defines at least one internal compartment for removably receiving material to be displayed and has an associated external compartment for receiving additional material to be displayed. The display member has at least one alternative embodiment wherein more than one internal display compartment and more than one external display compartment is provided.

An object of the present invention is to provide a portable display device for organizing, transporting and displaying material. The present invention is particularly advantageous for transporting and displaying material and items (brochures, photographs, business cards and the like) used in the real estate market, but it may be used in any setting where information or material is displayed or distributed.

Another object of the present invention is to provide a portable display device including a tray and a display member movably coupled to the tray wherein the device can be folded or manipulated quickly and easily for transportation without assembly or disassembly and without removing the displayed material.

Yet another object of the present invention is to provide a portable display device wherein a transparent or substantially transparent display member for receiving material to be displayed or distributed is pivotally coupled to a main tray-like base container which also receives material to be displayed or distributed.

An advantage of the present invention is that it combines the transportation and display of multiple kinds of material, such as 8½"×11" sheet material, trifold-type brochures and business cards, without requiring assembly and disassembly.

Another advantage of the present invention is that the display member, although semi-permanently connected to the main tray, may be removed easily therefrom without special tools, so that an interchangeable, alternative display member with a different configuration may be installed. Even though the present invention serves to organize and protect display material during transportation, it provides for the quick, convenient deployment and display of such material upon arrival at the point of use.

Other objects and advantages of the present invention will become more fully apparent and better understood with reference to the following specification and to the appended drawings and claims.

DETAILED DESCRIPTION OF THE PREFERRED EMBODIMENT

Figure 1:
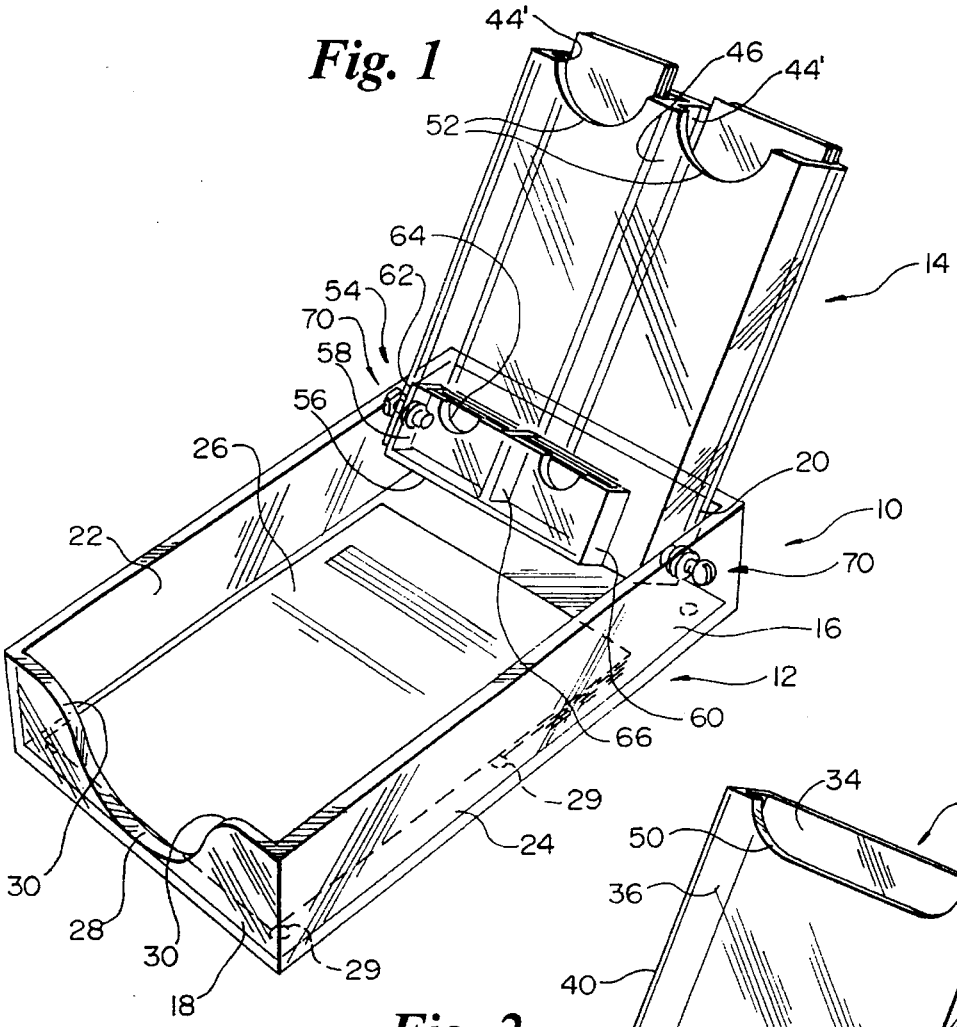
FIG. 1 is a perspective view of the present invention in its open display position with documents and other display material contained and presented for display and distribution.

As shown in the Figs., a display device 10 in accordance with the present invention includes a base tray 12 and a display member 14.

The base tray component 12 has a bottom wall 16, a front wall 18, a rear wall 20 and two parallel side walls 22, 24. Together, the bottom, front, rear and side walls are joined at their intersections by appropriate means (e.g., adhesively, by mechanical fasteners such as screws or the like, or by welding) to define an upwardly open material receiving area. The area, and therefore the base tray 12 generally, preferably is sized to hold a stack of standard sheet material, such as 8½"×11" sheets or 8½"×14" sheets, such sheet material being indicated at 26 in FIGS. 1 and 3. The front wall 18 of the base tray 12 includes a generally central relieved region 28 to facilitate the removal of the sheet material 26 therefrom. The relieved region 28 includes radiused or rounded corners, both indicated at 30. Although the side walls 22, 24 are shown as substantially level and continuous along their upper edge, they may be provided with relieved region similar to relieved region 28. A plurality of tacky, slip-preventing pads 29 are provided on the underside of the bottom wall 16.

The display member 14 comprises a substantially continuous rear wall 34, a front wall 36, side walls 38, 40 and a bottom wall 42. Together the walls of the display member 14 are joined to define a hollow material receiving cavity indicated generally at 44. The cavity 44 is free of obstruction and has an open upper edge or top. The display member 14 may be provided in alternative embodiments. For example, in the embodiment of the display member 14 depicted in FIG. 1, the display member 14 includes a generally central divider wall 46 generally parallel to the side walls 38, 40 and extending from the bottom wall 42 to the open top of the display member 14. The divider wall 46 splits or divides the member 14 to provide two material receiving cavities, both indicated at 44'. In the embodiment depicted in FIG. 2 (common elements of the display member(s) 14 being commonly numbered), the cavity 44 is not divided whereby it accommodates 8½"×11" sheets. In either embodiment, adjacent to the upper, front edge of the front wall 36, the member 14 is provided with a relieved region 50 to facilitate removal of material, such as the brochures 51 (shown in FIG. 1). In the embodiment depicted in FIG. 1, wherein the display member 14 includes multiple material receiving cavities 44', a relieved region 52 is provided for each cavity. Although not shown with rounded corners, the corners may be rounded similarly to the corner of the region 28.

Figure 2:
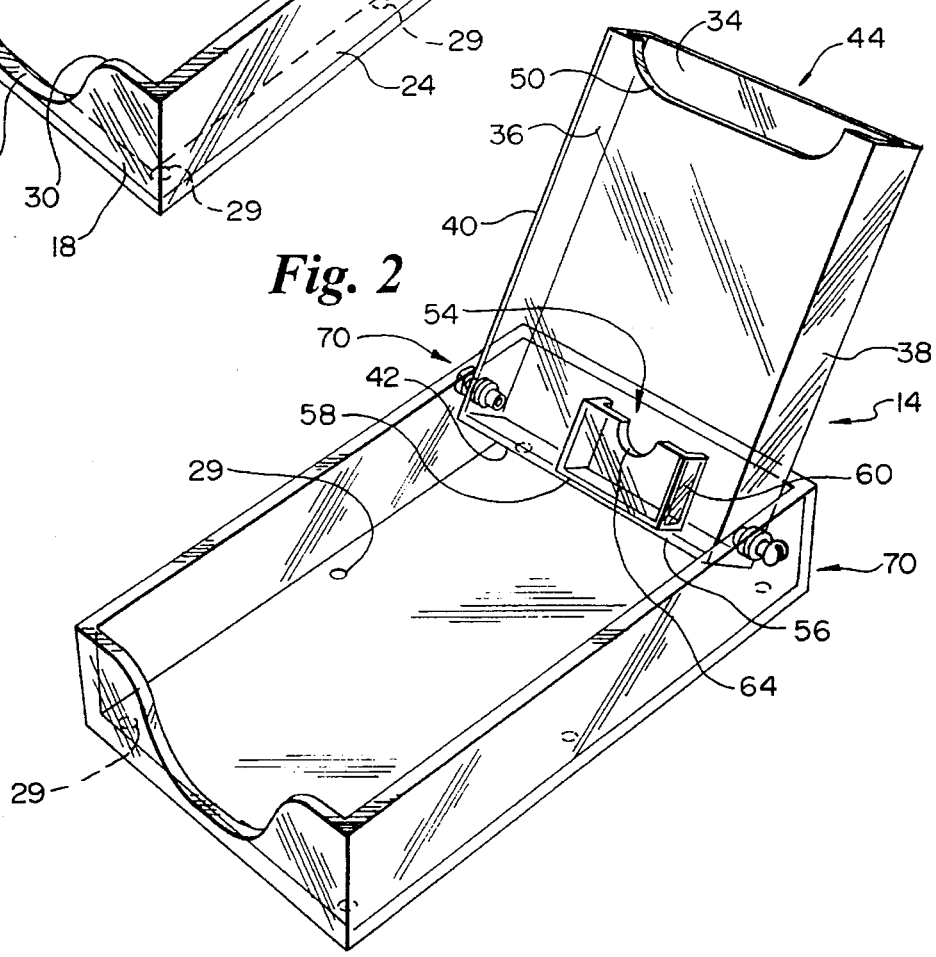
FIG. 2 is a perspective view of an alternative embodiment of the display device of the present invention with the bottom of the external business card pocket moved upward from the bottom wall of the display member and a single internal compartment display member.

With continued reference to the Figs., an external material receiving receptacle 54 is attached to the display member 14. The external receptacle 54 is specially adapted for business cards and is defined by a bottom wall 56, a front wall 58 and two generally parallel side walls 60, 62. As in the base tray 12 and the display member 14, the front wall 58 is provided with a relieved region 64. Like the display member 14, the external receptacle 54 may be available in multiple embodiments. Referring to FIG. 1, the external receptacle 54 is split by a generally central divider 66 parallel to the side walls 60, 62. In FIG. 2, a single external receptacle 54 is associated with the display member 14 and the bottom wall 56 thereof is slightly set off above the bottom wall 42 of the display member 14.

Figures 3, 4:
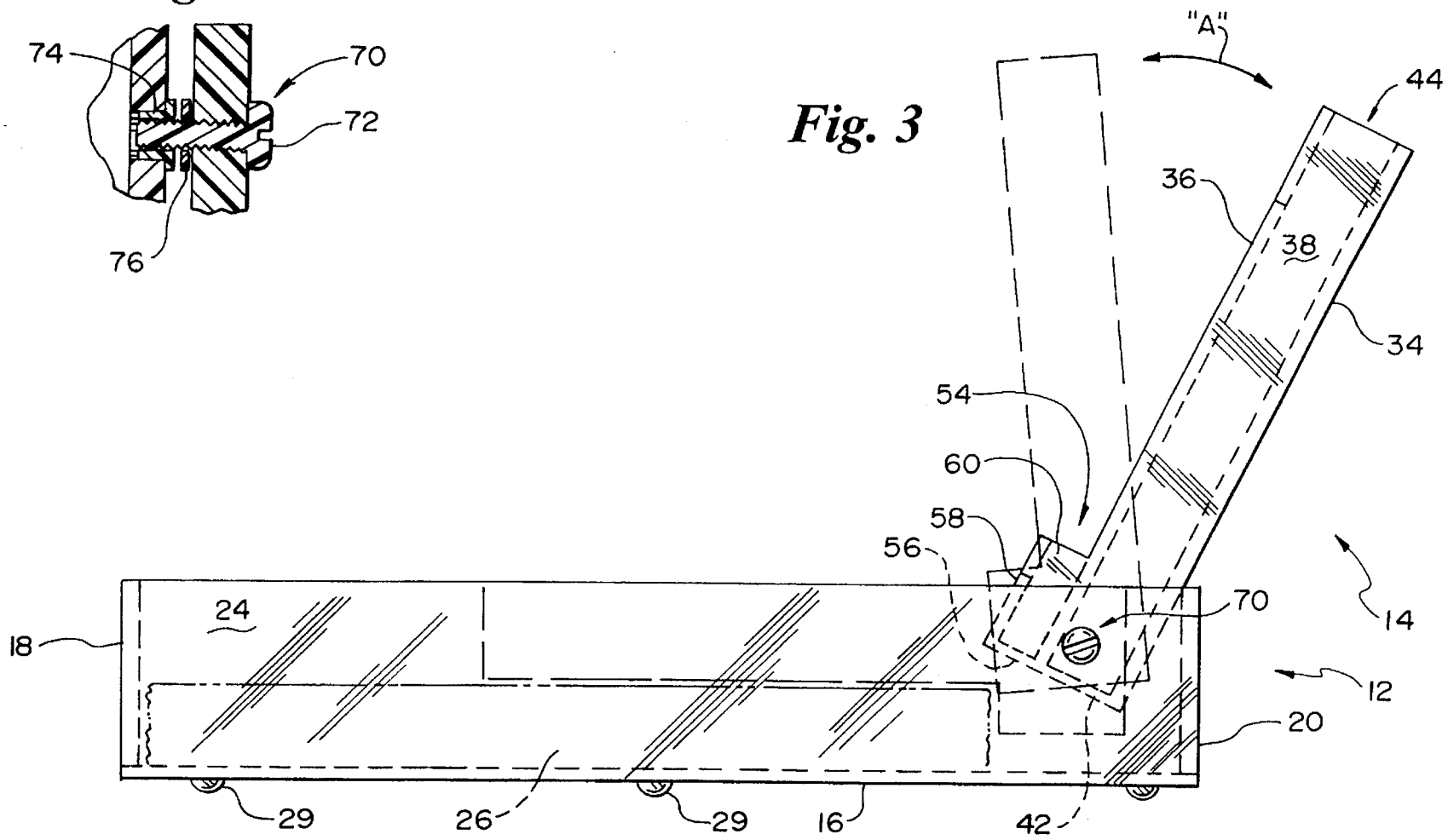
FIG. 3 is a side elevation of the display device of the present invention in its open display position depicting the preferred display angle of the display member relative to the base tray, including a phantom position depicting the movement of the display element into its closed position (shown in phantom) wherein the display member is generally parallel to and nested in the material receiving area of the base tray.
FIG. 4 is a fragmentary section through one of the pivot trunion joints movably coupling the display member to the base tray.

Referring to FIG. 3, the range of motion of the display member 14 relative to the base tray member 12 is depicted. Broadly, the display member 14 has two operational positions, fully opened display position and a closed position (the closed position depicted in phantom). The hinged or pivotal folding movement of the display member 14 between the two positions is enabled by the trunion connectors, both indicated at 70, at each side of the display device 10.

FIG. 4 depicts one of the substantially identical trunion connectors 70. Specifically, the connectors 70 include a threaded screw-like pin 72, a generally cylindrical trunion guide bushing 74 with a shoulder 75 and a spacer washer 76. The trunion bushing 74 is received and secured (glued or friction fit) in an aperture in the side walls 36, 38 of the display member 14 adjacent to the bottom wall 42 thereof. The pin 72 is received in tapped apertures provided near the upper edge of the side walls 22, 24 of the base tray 12 adjacent to the rear wall 20. When the display member 14 and tray 12 are connected (FIGS. 1 and 2), the pins 72 are coaxial and provide a hinge or pivot about which the display member 14 moves through an arc. It should be appreciated from FIG. 4 that the trunion bushing 74 and pin 72 do not extend into the cavity 44 of the display member 14, thereby preventing interference with the contents of the cavity 44.

One of the advantages of the present invention is depicted in FIG. 3. In the fully open position, the display member 14 rests against the rear wall 20 of the base tray 12 at an angle of approximately 30 degrees past vertical relative to the bottom wall 16 of the base tray 12, i.e., the angle between the bottom wall 16 and the front wall 36 of the display member is about 120°. This angle, which may be varied between about 110° to 140° degrees, provides for the attractive, easily perceived viewing or display of material contained in the internal cavity 44 of the display member 14. With continued reference to FIG. 3, in the closed position (depicted in phantom) the display member 14 is nested substantially within the tray 12 and rests against any display material 26 contained in the base tray 12. Depending on the amount of material 26 in the tray 12, the front wall 36 or only the upper front edge thereof will contact the material 26. This contact helps to hold the material 26 in place during transportation or movement of the display device 10.

Although not depicted, it should be appreciated that the display device 10 of the present invention may be carried by hand or in a briefcase or the like generally vertically in its closed position. By generally vertically, it is meant that the rear wall 20 of the base tray 12 and the bottom walls 56, 42 of the external receptacle 54 and display member 14, respectively, are generally parallel and in the lowermost position, i.e., the device 10 is rotated 90 degrees from its closed position shown in FIG. 3. Moving the display device 10 in this position, i.e., with the front wall 18 and the openings of the external receptacle 54 and internal cavities 44, 44' uppermost, will provide that material 26 contained by the display device 10 will remain in place.

Another advantage of the present invention is associated with the trunion pivot joints 70. The joints 70 semi-permanently and movably connect to the base tray 12, but it should be appreciated that the complimentary threaded and tapped nature of the joint pins 72 and apertures in the side walls 22, 24 of the base tray 12 make it convenient and easy to remove one display member 14 (e.g., the embodiment depicted in FIG. 2), and replace it with another display member embodiment (e.g., the display member embodiment depicted in FIG. 1).

In use, a sales person or real estate agent may carry the display device 10 of the present invention in closed position to a point of sale or display. The device 10 may be filled with information carrying material 26 such as sheet material, tri-fold brochures or business cards prior to leaving for the site or, upon arrival, after the display member 14 is moved to its open display position as shown in FIG. 3 If it is necessary to move the display device 10 to another location, either at the same site or to an other site, the display member 14 may be pivoted downwardly toward its closed position along the arc "A" shown in FIG. 3 without removing the displayed material 26 therefrom. It should be appreciated that when closed the display member 14 and the base tray 12 are nested and that the display device 10 occupies a minimum of space and may be moved easily. When closed, placed in a generally vertical position (i.e., as if it were standing on the rear wall 20) and inserted in a briefcase or carried by hand to another location the material 26 and the device 10 will tend to remain organized and in place.

The display device 10 of the present invention, as depicted all of the Figs., is preferably entirely formed of a clear, durable and scratch-resistant material such as Lexan® or suitable polycarbonate or other plastic material. Nonetheless, portions of the device 10 may be formed from non-transparent material or may carry permanent marking or color, as long as at least the front wall 36 of the display member 14 and the front wall 58 of the external receptacle 54 are substantially clear so that dispaly material 26 or other items may be visible therethrough.

A number of other variations of the present invention can be made. For example, the internal dimensions of the base tray 12, the cavity(s) 44 (or 44') of the display member 14 and the material receiving cavity of the external receptacle 54 may be provided in various sizes to accommodate many different types of material. Portions of the display device 10 such as the front wall may be curved or otherwise adapted to display specific materials. Various methods might be used to releasably lock the display device 10, particularly the display member 14, in its open and closed positions. For example, a coil spring or ball and socket detent, a push in and twist or bayonet type releasable lock might be incorporated in the trunion pivot joints 70 joining the display member 14 to the base tray 12. Alternatively, when the display member 14 is in its open position, an elastic strap or band may be connected to the rear uppermost edge of the display member 14 and extend and be attached to a portion of the base tray 12 to hold the display member 14 in its open position. Various suitable hinges might be used to interconnect the base tray 12 and display member 14, for example, a continuous "living" hinge or a piano-type hinge may be positioned along the upper edge of the rear wall 20 and an edge of the bottom wall 42 of the display member 14. Other equivalent hinge structures might be used as well, as long as the display member 14 is free to move into its open and closed positions. Hinged, releasably lockable covers (e.g., by snap locks) may be may be provided at the open ends of the cavities 44, 44' and the external receptacle 54. The display device 10 may be marked with appropriate instructions and portions of it may be provided with permanent or semi-permanent displays of information.

A carrying handle may be provided on the front wall 18 of the base tray 12 to facilitate transportation of the display device 10.

It should be understood that as an alternative to purchasing or obtaining the display device 10 in one of its embodiments (either FIG. 1 or 2), the purchaser may obtain the device 10 as an assembled unit and later obtain another embodiment of the display member 14. Additionally, although only two embodiments of the display member 14 are shown, it should be appreciated that other embodiments may be provided as well.

Although the description of the preferred embodiment has been presented, it is contemplated that various changes, including those mentioned above, could be made without deviating from the spirit of the present invention. It is therefore desired that the preceding description be considered as illustrative, not restrictive, and that reference be made to the appended claims rather than to the foregoing description to indicate the scope of the invention.

What is claimed is:

1. A portable display device comprising:

a base tray member having a generally flat bottom wall, a front wall, a rear wall and generally parallel side walls, the front wall including a relieved region along an upper edge to facilitate the removal of an item from the base tray member;

a display member formed by display member walls including a bottom wall, a rear wall, a front wall and generally parallel side walls, said display member walls defining an internal cavity with an open top, said display member movably coupled to the base tray member adjacent to the rear wall of the base tray member for movement between a closed and an open position through an arc between said closed position in which said display member is generally nested in the base tray member and said open position in which said display member is generally upright and transverse to the base tray member; and an external receptacle connected to the display member for removably receiving material to be displayed, Said external receptacle having a bottom wall, a front wall, side walls and a rear wall formed by a portion of the front wall of the display member, wherein the front wall of the display member and the front wall of the external receptacle are transparent, each having an upper edge with a relieved region to facilitate the removal of an item therefrom.

2. A display device for transporting at least two sizes of material to a site, for displaying and dispensing the material at the site and for transporting the material to another site, said display device comprising:

a tray formed by a generally flat tray bottom wall having a tray bottom wall peripheral edge, a tray front wall connected to a portion of the tray bottom wall peripheral edge and generally perpendicular to the tray bottom wall, a tray rear wall connected to another portion of the tray bottom wall peripheral edge and generally parallel to the tray front wall, and two tray side walls generally parallel with respect to each other and generally perpendicular to the tray bottom wall;

a display member formed by a display member bottom wall with a display member bottom wall peripheral edge, a display member rear wall connected to a portion of the display member bottom wall peripheral edge and generally perpendicular to the display member bottom wall, a display member front wall connected to another portion of the display member bottom wall peripheral edge and generally parallel to the display member rear wall and two display member side walls generally parallel with respect to each other and generally perpendicular to said display member bottom wall, said display member bottom, rear, front and side walls defining an internal cavity with an open top opposite to said display member bottom wall, said display member movably coupled to the tray side walls adjacent to the tray rear wall, said display member movable through an arc between a closed, transport position in which said display member is nested in the tray and an open position in which said display member is transverse to the tray and generally upright; and an external receptacle formed by a receptacle bottom wall with a receptacle bottom wall peripheral edge, said receptacle bottom wall connected to the display member front wall along a portion of said receptacle bottom wall peripheral edge and generally perpendicular to the display member front wall, a receptacle front wall connected to another portion of the receptacle bottom wall peripheral edge and generally parallel to the display member front wall, two receptacle side walls generally parallel with respect to each other and generally perpendicular to the display member front wall, and a receptacle rear wall formed by a portion of the display member front wall, said external receptacle having an open-top opposite to said receptacle bottom wall.

3. The display device according to claim 2, wherein said tray has an open top generally congruent to the tray bottom wall.

4. The display device according to claim 2, further comprising hinge means for movably coupling the display member and tray.

5. The display device according to claim 2, wherein said external receptacle is adjacent to the display member bottom wall.

6. The display device according to claim 2, further comprising joining means for movably coupling the display member and tray.

7. The display device according to claim 6, wherein said joining means comprises a pair of pin and socket arrangements, one at each side of the display device and each including a socket associated with the respective display member side wall and a pin extending through the respective tray side wall and into the socket, the pins generally coaxial.

8. The display device according to claim 2, wherein the tray front wall, the display member front wall and the receptacle front wall each have an upper edge and a relieved region located along said upper edge to facilitate the removal of an item therefrom.

9. The display device according to claim 2, wherein the display member further comprises a divider wall generally parallel to the display member side walls for dividing said internal cavity into two internal cavities.

10. The display device according to claim 9, wherein the display member front wall has an upper edge and two relieved regions, each of said relieved regions associated with one of the internal cavities.

11. The display device according to claim 2, further comprising a second external receptacle substantially similar to the other external receptacle and adjacent thereto.

* * * * *